United States Patent [19]

Clement

[11] 3,960,317

[45] June 1, 1976

[54] MAIL BOX WITH SIGNAL ATTACHMENT

[76] Inventor: James H. Clement, 1635 Rocky Mountain Ave., Milpitas, Calif. 95035

[22] Filed: Feb. 18, 1975

[21] Appl. No.: 550,833

[52] U.S. Cl. ..... 232/35; 232/34

[51] Int. Cl.² ..... B65D 91/00

[58] Field of Search ..... 232/35, 34

[56] References Cited

UNITED STATES PATENTS

| | | | |
|---|---|---|---|
| 707,554 | 8/1902 | Coursen | 232/35 |
| 826,416 | 7/1906 | Forwood | 232/34 |
| 923,818 | 6/1909 | Davis | 232/35 |
| 1,990,003 | 2/1935 | Schlenker | 232/35 |
| 2,985,360 | 5/1961 | Stapleton | 232/35 |
| 3,176,918 | 4/1965 | Posch | 232/35 |
| 3,830,424 | 8/1974 | Pittman | 232/35 |

*Primary Examiner*—James T. McCall
*Assistant Examiner*—Darrell Marquette
*Attorney, Agent, or Firm*—Jack M. Wiseman

[57] ABSTRACT

A mail box with a signal attachment in which the opening of the door causes a bracket to activate a pivotally mounted hollow signal arm. The activation of the hollow signal arm moves the hollow signal arm into a substantially upright position. Weight means within the hollow signal arm urges the hollow signal arm into a substantially upright position and maintains the hollow signal arm in the upright position until an operator manually resets the hollow signal arm to its initial position.

11 Claims, 4 Drawing Figures

MAIL BOX WITH SIGNAL ATTACHMENT

BACKGROUND OF THE INVENTION

The present invention relates in general to mail boxes installed at locations removed from the place of residence or business, and more particularly to a mail box having a signal to indicate the presence of mail in the mail receptacle thereof.

Heretofore, mail boxes have employed flags or other signaling devices to indicate the presence of mail in the mail box. In such boxes, the opening of the door by the mail carrier to place mail in the mail box activated linkage to raise a flag arm in the upright position. The flag arm remained in the upright position until an operator reset the mail arm to its initial position. However, some of such mail boxes employed stops to hold the flag arm in the upright position as disclosed in the patent to Cooper U.S. Pat. No. 3,168,239 and the patent to Palmer U.S. Pat. No. 1,149,781. In other mail boxes of this general type, cam arrangements served to raise the flag arm to the upright position and to maintain the flag arm in the upright position. Arrangements of this nature are disclosed in the patent to Oliver U.S. Pat. No. 918,899 and the patent to Barkdoll U.S. Pat. No. 2,838,230. Other patents disclose mail boxes with articulated linkage for the raising of the flag arm to the upright position and holding the flag arm in the upright position as disclosed in the patent to Cox et al. U.S. Pat. No. 2,905,378 and the patent to Scott U.S. Pat. No. 1,521,397. In the patent to Stouten U.S. Pat. No. 2,852,185, a mail box is disclosed therein in which the opening of the door to insert mail into the mail box serves to raise a flag post to an upright position, and a weighted end of an arm connected to the flag post maintains the flag post in the upright position until an operator resets the flag post to its initial position.

In certain of the mail boxes above-described, it is difficult to attach the signaling devices to the mail box. Such signaling devices are very complicated and, therefore, are difficult to mount on the mail box. Additionally, when certain of the signaling devices above-described are subject to inclement weather conditions, such as freezing weather, such signaling devices tend to impede the opening and closing of the mail box door. This arises from the mechanical connection between the signaling devices, the mail receptacle and the door.

SUMMARY OF THE INVENTION

A mail box with a signal attachment in which a hollow signal arm supports a signal device and in which the movement of the door of the mail box places the hollow arm in a signal position and the hollow arm is urged into the signal position by freely movable weight means disposed therein.

By virtue of the present invention, the signal attachment of the mail box performs without disruption under inclimate weather conditions. The signal attachment of the present invention is less complicated and cumbersome so as to reduce the costs of manufacture thereof and still it has improved upon its durability and its reliability. By simplifying the construction thereof, the parts are not subject to wear and tear as heretofore realized and yet the parts thereof are not subject to malfunctioning under inclimate weather conditions as previously was the case. It is to be observed that the signaling attachment of the present invention is supported entirely by the door of the mail box and is not attached to the mail receptacle of the mail box.

DESCRIPTION OF THE PREFERRED EMBODIMENTS

Figure 1:
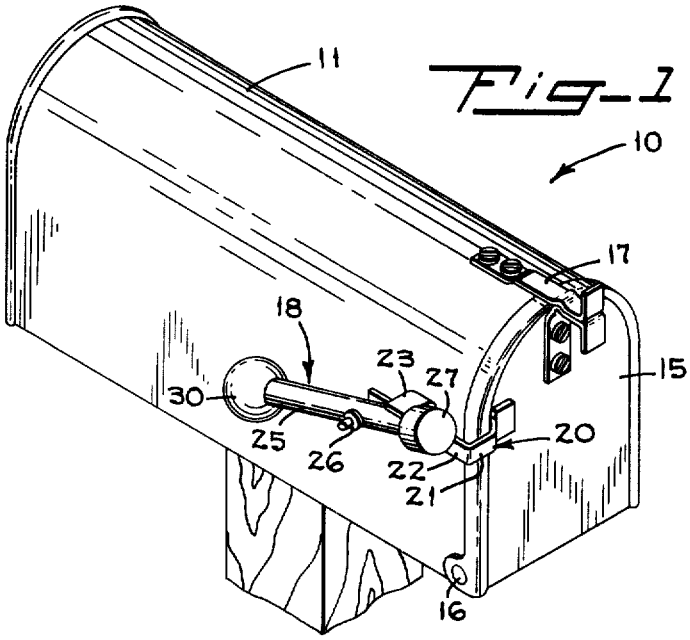
FIG. 1 is a perspective view of a mail box embodying the present invention.

Illustrated in FIG. 1 is a mail box 10 embodying the present invention. The mail box 10 comprises a receptacle 11 in which mail is deposited by a mail carrier. In the exemplary embodiment, the receptacle 11 is of sheet metal construction and has the usual side wall formed of a single sheet of metal rolled or bent in the usual manner to form the sides and curved top. A rear wall closes the rear of the receptacle 11 and a bottom wall joins the side walls and the rear to complete the enclosure of the receptacle, except for the front opening.

A door 15 of appropriate shape to close the front opening is mounted to the front of the box by a pivot hinge 16 located along the lower edge thereof. The door 15 pivots along the lower edge thereof to be swung into an upright position to close the receptacle 11 or swung down to a horizontal position to open the receptacle 11. A suitable latch 17 normally holds the door 15 in the upright position to close the receptacle 11. The door 15 is opened manually against the urgency of the latch 17.

According to the present invention, fixed to the door 15 for movement therewith is an integrally formed substantially Z-shaped mounting bracket 20 for a signaling attachment 18. The substantially Z-shaped mounting bracket 20 includes a portion 21 that is secured at one end thereof to the door 15 for movement therewith by suitable means, such as screws or an adhesive. At right angles to the other end of the portion 21 is one end of an extension portion 22. At right angles to the other end of the extension portion 22 is a pivot support portion 24. The pivot support portion 24 is oppositely directed with respect to the portion 21.

Intermediate the ends of the extension portion 22 and joined at right angles thereto is a right angular or L-shaped stop portion 23. The free end of the stop portion 23 is directed in the same direction as is directed the pivot support portion 24 from the extension portion 22, and it is parallel to the pivot support portion 24. However, it is spaced therefrom by a distance of a portion of the length of the extension portion 22 and additionally by a distance of the length of the member of the stop portion 23 joined to the extension portion 22.

A hollow signal or flag arm 25 is pivotally mounted on and freely supported for pivotal movement by the pivot support portion 24 of the bracket 20 intermediate the ends of the signal arm 25. A suitable cap nut 26 and the junction between the pivot support portion 24 and the extension portion 22 limit the radial movement of the signal arm 25 on the pivot support portion 24. One end of the hollow signal arm 25 is closed by a suitable cap 27. At the other end thereof, the hollow signal arm 25 carries a suitable signal device 30, such as a sphere or a flag, for movement therewith. Contained in the hollow signal arm 25 on each side of the pivot support portion 24 is a suitable weight, such as weights 31 and 32. In the preferred embodiment, the hollow signal arm 25 is tubular in construction and the weights 31 and 32 are freely movable solid metal spheres. In the exemplary embodiment, there is a solid metal sphere on each side of the pivot support portion 24. However, liquid weights may be employed in lieu thereof.

Figure 2:
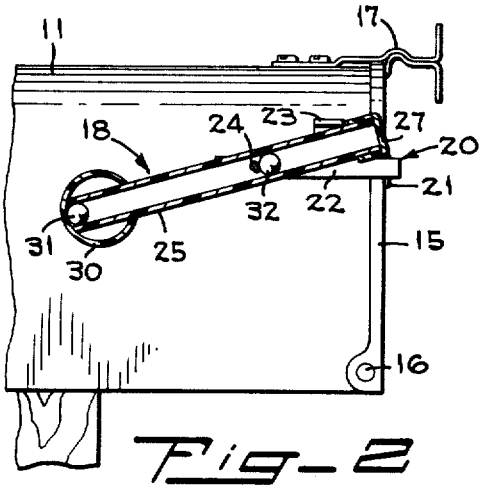
FIG. 2 is a fragmentary side elevation view of the mail box shown in FIG. 1 with the signal attachment thereof partially shown in cross-section and illustrating the "no" mail signal or the initial position.
Figure 4:
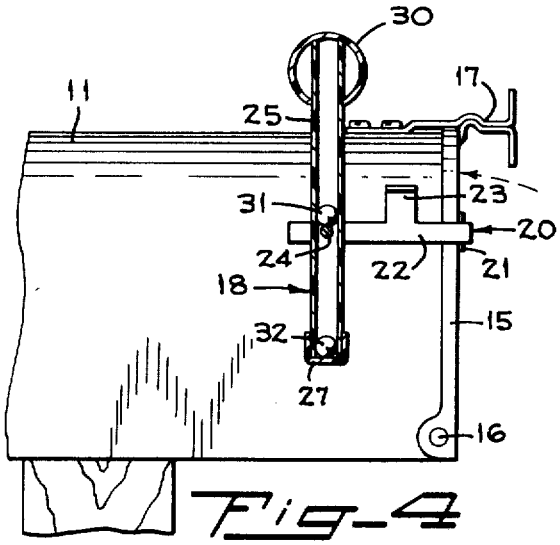
FIG. 4 is a fragmentary side elevation view similar to FIGS. 2 and 3, but with the mail box door in the closed position for illustrating the maintenance of the signal attachment in the yes mail position.

Initially (FIG. 2), the door 15 is closed. The extension portion 22 of the bracket 20 is substantially horizontal. The hollow signal arm 25 is inclined axially in the direction from the signal device 30 to the cap 27. At this time, the weight 31 is at the signal end of the hollow signal arm 25 and the weight 32 is at the pivot support portion of the bracket 20. The cap end of the hollow signal arm 25 is disposed below and engages the L-shaped stop portion 23 of the bracket 20. Since the weight 31 tends to urge the signal arm 25 to pivot in the counterclockwise direction, as viewed in FIG. 1, the stop portion 23 of the bracket 20 limits the movement of the hollow signal arm 25 in the counterclockwise direction. The weight 31 exerts at this time a greater turning movement than does the weight 32.

When an operator opens the door 15 (FIG. 3) to the fully extended, substantially horizontal position, the door 15 pivots about the pivot hinge 16 along the lower edge of the door 15. This action through the bracket 20 gradually changes the position of the hollow signal arm 25 from the aforementioned inclined position to a horizontal position. As the pivotal movement of the door 15 about the pivot hinge 16 is continued to the substantially horizontal position, the hollow flag arm 25 starts to decline in the direction of the signal device 30 to the cap 27. Once the hollow signal arm 25 begins the aforesaid decline, the stop portion 23 of the bracket 20 no longer serves as a stop. The hollow signal arm 25 is now pivoting in the clockwise direction, as viewed in FIG. 1, under the urgency of the weight 32. The weights 31 and 32 start to shift positions in the hollow signal arm 25 and gravitate as the aforesaid decline takes place. The shifting of position of the weight 32 causes the hollow signal arm 25 to move clockwise and to assume the upright position with the signal device 30 at the elevated position. At this time, the weight 32 exerts a greater turning movement than the weight 31 and also the weight 32 dominates the weight 31 in maintaining the signal arm 25 in the upright position. The shifting of the position of the weights 31 and 32 brings the weight 31 to the pivot support portion 24 and brings the weight 32 to the cap end of the hollow signal arm 25.

Figure 3:
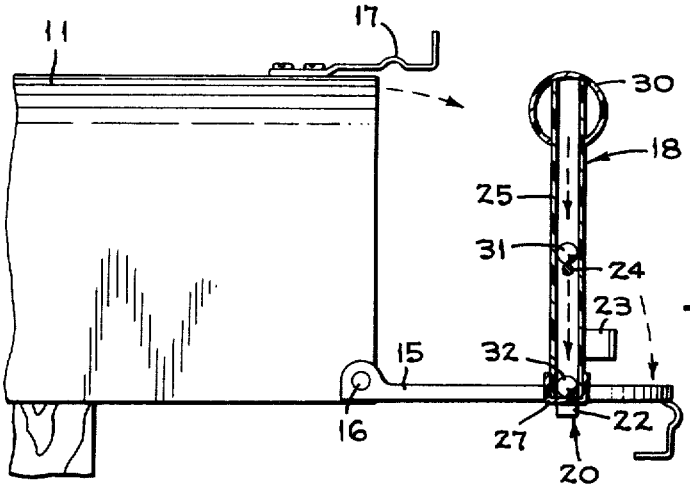
FIG. 3 is a fragmentary side elevation view similar to FIG. 2, but with the mail box door in the fully extended opened position for illustrating the positioning of the signal attachment in the "yes" mail position.

At this time, the operator places the mail in the receptacle 11 and closes the door 15 (FIG. 3). During the closure of the door 15 and while the door 15 is closed, the hollow flag arm 25 is maintained in the upright position by the weight 32. After mail is removed from the receptacle 11, the hollow signal arm 25 is manually reset to its initial position (FIG. 1).

I claim:

1. A mail box comprising:

a. a receptacle in which mail is deposited, said receptacle being formed with an opening through which mail is deposited into said receptacle;

b. a door pivotally mounted on said receptacle, said door being movable between a position to close said opening and a position to open said opening;

c. a bracket fixed to said door for movement therewith;

d. a hollow arm carried by said bracket for pivotal movement about a transverse pivot axis and movable by said bracket in response to said door being moved between said positions;

e. means disposed in said hollow arm intermediate the ends thereof and adjacent said pivot axis, said means extending in a generally transverse direction of said hollow arm for dividing the interior of said hollow arm; and f. weight means located on each side of said means and freely movable in said hollow arm between the associated end of said hollow arm and said means for urging said hollow arm into a signal position in response to said bracket moving said hollow signal arm a sufficient extent to cause said weight means to move within said hollow signal arm.

2. A mail box as claimed in claim 1 wherein said bracket includes a pivot support for freely supporting said hollow signal arm and said means is a part of said pivot support.

3. A mail box as claimed in claim 2 wherein said bracket includes a stop for limiting the pivotal movement of said hollow signal arm in one direction under the urgency of said weight means, and wherein the movement of said weight means within said hollow signal arm urges said hollow signal arm into a pivotal movement in an opposite direction for being disposed in said signal position.

4. A mail box as claimed in claim 3 wherein said door is hinged to said receptacle along the lower edge of said door for pivotal movement and wherein the movement of said door from the closed position to the opened position causes said weight means to urge said hollow signal arm to raise its signal end portion to a generally upright position for said signal position, said weight means maintaining said hollow signal arm in the upright position.

5. A mail box as claimed in claim 4 wherein said door is in the closed position and said hollow signal arm is initially at an inclined position from its signal end portion to its opposite end and wherein said weight means urges said hollow signal arm in said one direction into engagement with said stop, said movement of said door from said closed position to said open position moves said bracket to carry said hollow signal arm into a horizontal position and the continued movement of said door to said opened position moves said weight means to urge said hollow signal arm to move in said opposite direction into a declining position from said signal end of said hollow signal arm to said opposite end of said hollow signal arm and thence into said generally upright signal position, said weight means maintaining said hollow signal arm in said generally upright position after said door is returned to its closed position.

6. A mail box as claimed in claim 5 wherein said stop is in the vicinity of said opposite end of said hollow signal arm.

7. A mail box as claimed in claim 6 wherein said hollow signal arm is in the form of a tubular arm and said weight means is in the form of a spheroid.

8. A mail box as claimed in claim 7 wherein said pivot support extends radially through said tubular arm for pivotally mounting said tubular signal arm to said bracket.

9. A mail box as claimed in claim 8 wherein said spheroids gravitate toward said signal end of said hollow signal arm when said hollow signal arm is in said inclined position and wherein said spheroids gravitate toward said opposite end when said hollow signal arm is in said declining position and said generally upright position.

10. A mail box comprising:

a. a receptacle in which mail is deposited, said receptacle being formed with an opening through which mail is deposited into said receptacle;

b. a door pivotally mounted on said receptacle, said door being movable between a position to close said opening and a position to open said opening;

c. a bracket fixed to said door for movement therewith;

d. a tubular signal arm carried by said bracket for pivotal movement and movable by said bracket in response to said door being moved between said positions, said bracket including a pivot support for freely supporting said tubular signal arm, said pivot support being disposed intermediate the ends of said tubular signal arm and extending radially through said tubular arm for pivotally mounting said tubular signal arm to said bracket; and e. a spheroid located on each side of said pivot support for free movement in said tubular signal arm, said bracket including a stop for limiting the pivotal movement of said tubular signal arm in one direction, said door being hinged to said receptacle along the lower edge of said door for pivotal movement, said spheroids urge said tubular signal arm in said one direction into engagement with said stop when said door is closed and said tubular signal arm is initially at an inclined position from its signal end portion to its opposite end, said stop being in the vicinity of said opposite end of said tubular signal arm, said movement of said door from said closed position to said open position moves said bracket to carry said tubular signal arm into a horizontal position and the continued movement of said door to said opened position moves said spheroids to urge said tubular signal arm to move in an opposite direction into a declining position from said signal end of said tubular signal arm to said opposite end of said tubular signal arm and thence into said generally upright signal position, said spheroids maintaining said tubular signal arm in said generally upright position after said door is returned to its closed position.

11. A mail box as claimed in claim 10 wherein said spheroids gravitate toward said signal end of said hollow signal arm when said hollow signal arm is in said inclined position and wherein said spheroids gravitate toward said opposite end when said hollow signal arm is in said declining position and said generally upright position.

* * * * *